United States Patent [19]

Krishnamurthy

[11] Patent Number: 4,728,599

[45] Date of Patent: Mar. 1, 1988

[54] STERICALLY HINDERED PHENOLIC ESTER PHOTOGRAPHIC COUPLER DISPERSION ADDENDA AND PHOTOGRAPHIC ELEMENTS EMPLOYING SAME

[75] Inventor: Sundaram Krishnamurthy, Penfield, N.Y.

[73] Assignee: Eastman Kodak Company, Rochester, N.Y.

[21] Appl. No.: 803,193

[22] Filed: Dec. 2, 1985

[51] Int. Cl.[4] ..... G03C 1/40; G03C 1/84; G03C 7/32

[52] U.S. Cl. ..... 430/546; 430/551; 430/512; 430/634; 430/931

[58] Field of Search ..... 430/546, 551, 512, 634, 430/931

[56] References Cited

U.S. PATENT DOCUMENTS

| | | | |
|---|---|---|---|
| 3,080,339 | 3/1963 | Gordon | 524/288 |
| 3,779,765 | 12/1973 | McCrossen et al. | 430/546 |
| 4,193,802 | 3/1980 | Mukunoki et al. | 430/512 |
| 4,268,593 | 5/1981 | Leppard et al. | 430/512 |
| 4,308,328 | 12/1981 | Salyer et al. | 430/512 |
| 4,327,175 | 4/1982 | Toda et al. | 430/546 |
| 4,407,940 | 10/1983 | Nakamura et al. | 430/546 |
| 4,451,558 | 5/1984 | Sugita et al. | 430/546 |
| 4,609,618 | 9/1986 | Sasaki et al. | 430/546 |

FOREIGN PATENT DOCUMENTS

| | | |
|---|---|---|
| 102839 | 7/1982 | European Pat. Off. . |
| 54-25823 | 1/1977 | Japan . |
| 59-149363 | 8/1983 | Japan . |

*Primary Examiner*—Richard L. Schilling
*Attorney, Agent, or Firm*—Harold E. Cole

[57] ABSTRACT

Photographic coupler dispersion addenda comprising phenolic esters of di-, tri- and tetra-carboxybenzene derivatives having bulky ortho substituents are described for incorporation in photographic emulsions and elements. The solvents are preferably employed in the cyan layer to protect the cyan dye against ferrous ion reduction. The solvents also provide improvements in yellow dye stability to light and cyan dye stability to light, heat and humidity.

9 Claims, No Drawings

STERICALLY HINDERED PHENOLIC ESTER PHOTOGRAPHIC COUPLER DISPERSION ADDENDA AND PHOTOGRAPHIC ELEMENTS EMPLOYING SAME

This invention relates to photographic coupler dispersion addenda and to silver halide photographic elements employing such compounds. In a particular aspect, it relates to such compounds comprising phenolic esters of di-, tri- and tetra-carboxybenzene derivatives having bulky ortho substituents.

Images are commonly obtained in the photographic art by a coupling reaction between the development product of a silver halide color developing agent (i.e., oxidized aromatic primary amino developing agent) and a color forming compound commonly referred to as a coupler. The dyes produced by coupling are indoaniline, azomethine, indamine or indophenol dyes, depending upon the chemical composition of the coupler and the developing agent. The subtractive process of color formation is ordinarily employed in multicolor photographic elements and the resulting image dyes are usually cyan, magenta and yellow dyes which are formed in or adjacent to silver halide layers sensitive to radiation complementary to the radiation absorbed by the image dye; i.e. silver halide emulsions sensitive to red, green and blue radiation.

The patent and technical literature is replete with references to compounds which can be used as couplers for the formation of photographic images. Preferred couplers which form cyan dyes upon reaction with oxidized color developing agents are phenols and naphthols. Representative couplers are described in the following patents and publications: U.S. Pat. Nos. 2,772,162, 2,895,826, 3,002,836, 3,034,892, 2,474,293, 2,423,730, 2,367,531, 3,041,236, 4,333,999, and "Farbkuppler-eine Literaturubersicht," published in Agfa Mitteilungen, Band II, pp. 156–175 (1961).

Preferred couplers which form magenta dyes upon reaction with oxidized color developing agent are pyrazolones, pyrazolotriazoles, pyrazolobenzimidazoles and indazolones. Representative couplers are described in such patents and publications as U.S. Pat. Nos. 2,600,788, 2,369,489, 2,343,703, 2,311,082, 2,673,801, 3,152,896, 3,519,429, 3,061,432, 3,062,653, 3,725,067, 2,908,573 and "Farbkuppler-eine Literaturubersicht," published in Agfa Mitteilungen, Band II, pp. 126–156 (1961).

Couplers which form yellow dyes upon reaction with oxidized color developing agent are acylacetanilides such as benzoylacetanilides and pivalylacetanilides. Representative couplers are described in the following patents and publications: U.S. Pat. Nos. 2,875,057, 2,407,210, 3,265,506, 2,298,443, 3,048,194, 3,447,928 and "Farbkuppler-eine Literaturubersicht," published in Agfa Mitteilungen, Band II, pp. 112–126 (1961).

When intended for incorporation in photographic elements, couplers are commonly dispersed therein with the aid of a high boiling organic solvent, referred to as a coupler solvent. Couplers are rendered nondiffusible in photographic elements, and compatible with coupler solvents, by including in the coupler molecule a group referred to as a ballast group. This group is normally located on the coupler in a position other than the coupling position and imparts to the coupler sufficient bulk to render the coupler nondiffusible in the element as coated and during processing. It will be appreciated that the size and nature of the ballast group will depend upon the bulk of the unballasted coupler and the presence of other substituents on the coupler.

During photofinishing, developing agent sometimes gets carried over and mixed into the bleach solution, which results in reduction of ferric ion complexes in the bleach solution to ferrous ion complexes. The ferrous ions then have a tendency to reduce the cyan dye and convert it to a leuco form, causing a loss in dye density. Any alleviation of this problem would be most desirable.

U.S. Pat. No. 4,451,558 discloses various pthalic esters as coupler solvents for particular cyan couplers. Compound P-19 (comparison coupler solvent CS-1 referred to hereinafter) and Compound P-20 are similar to compounds of this invention, except that they do not have bulky ortho substituents in the ester moieties. However, these compounds are not as effective as the compounds of the invention in providing yellow dye stability to light, along with lessening the ferrous ion reduction of cyan dye problem, as will be shown by the tests hereinafter.

It would be desirable to provide a new class of coupler dispersion addenda useful in color photographic materials, particularly those having cyan couplers. It would also be desirable to provide such compounds which markedly reduce the tendency of ferrous ions to reduce cyan dye. Further, it would also be desirable to provide such compounds which would provide improvement in yellow dye stability to light and cyan dye stability to light, heat and humidity.

These and other objects are achieved in accordance with the invention which comprises a photographic element comprising a support having thereon at least one silver halide emulsion layer having associated therewith a dye-forming coupler dispersed in a coupler solvent therefor together with a dispersion addendum having the formula:

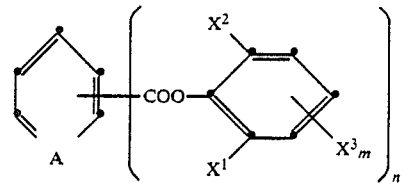

wherein

A is CH or N;

each $X^1$, $X^2$ and $X^3$ can independently be —H, halogen, —R, —CH=NOR, —COR, —$SO_2$R, —YR, —YCOR, —COYR, —Y$SO_2$R or —$SO_2$YR, wherein Y is O, S or NR′ and R′ is H or R;

or two X groups can join together to form a carbocyclic or heterocyclic ring;

R can be a substituted or unsubstituted alkyl group having from 1 to about 20 carbon atoms such as methyl, ethyl, isopropyl, sec-butyl, t-butyl, t-pentyl, 2-ethylhexyl or octadecyl; a substituted or unsubstituted aryl group having from 6 to about 20 carbon atoms such as phenyl, m-tolyl, p-tolyl, p-hydroxyphenyl or α-naphthyl; or a substituted or unsubstituted heterocyclic group having from 2 to about 20 carbon atoms such as pyrazolyl, benzoxazolyl, benzothiazolyl, benzotriazolyl or phenyltetrazolyl;

n is 2, 3 or 4 and each m is 1, 2 or 3, with the proviso that at least one pair of $X^1$ and $X^2$ substituents selected attached to the same benzene ring must contain a total of two or more non-hydrogen atoms.

In a preferred embodiment of the invention, the dye-forming coupler forms a cyan dye upon reaction with oxidized color developing agent, the coupler being a phenol or a naphthol, and the coupler, coupler solvent, and dispersion addendum are located in the silver halide emulsion layer.

In other preferred embodiments of the invention, n is 2 or 4; m is 1; A is CH; $X^1$ is an alkyl group of from 1 to about 6 carbon atoms, a heterocyclic group, —$COR^1$ wherein $R^1$ is phenyl or —$COOR^2$ wherein $R^2$ is an alkyl group of from 1 to about 6 carbon atoms; $X^2$ is H or an alkyl group of from 1 to about 6 carbon atoms; and $X^3$ is H, methoxy or an alkyl group of from 2 to about 6 carbon atoms.

Preferred compounds included within the scope of the invention include the following:

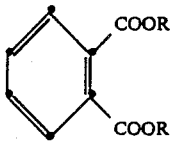

wherein R is

1.

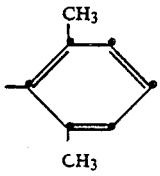

2.

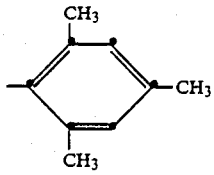

3.

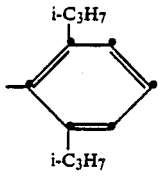

4.

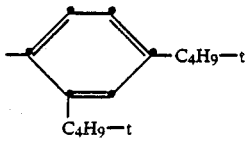

5.

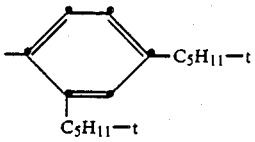

-continued

6.

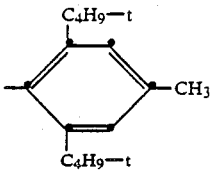

7.

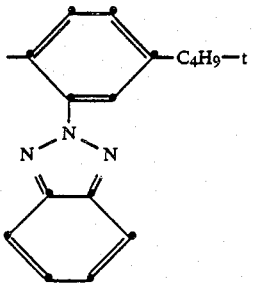

8.

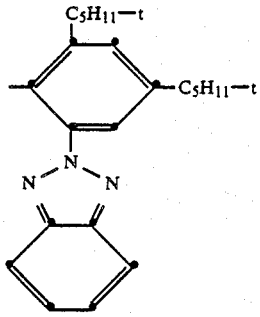

9.

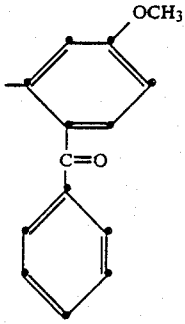

10.

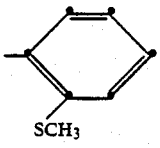

11.

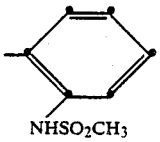

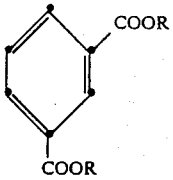

wherein R is
12.
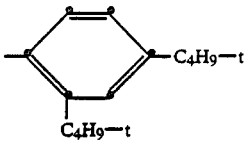
13.
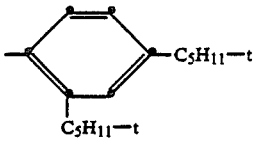
14.
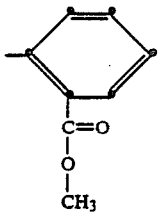
15.
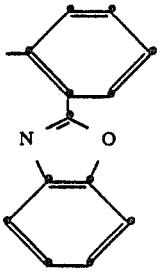
16.
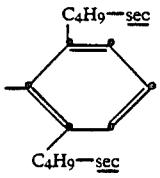
17.
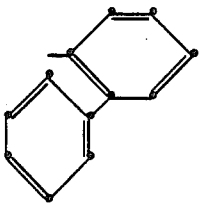
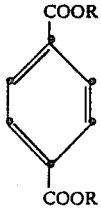
wherein R is
18.
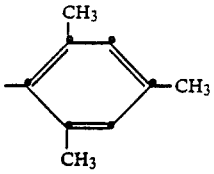
19.
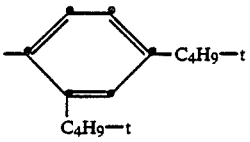
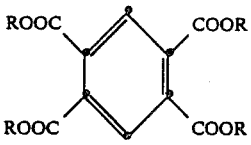
wherein R is
20.
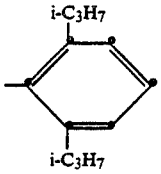
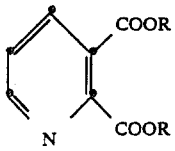
wherein R is
21.
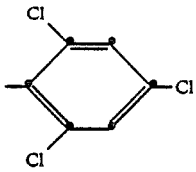
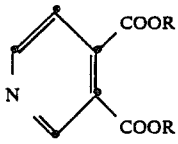
wherein R is
22.
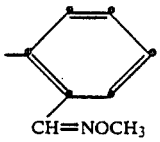

-continued

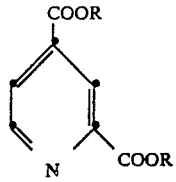

wherein R is

23.

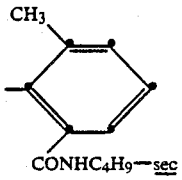

24.

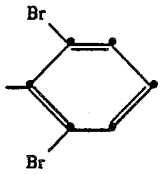

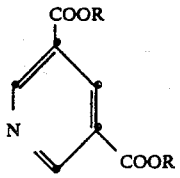

wherein R is

25.

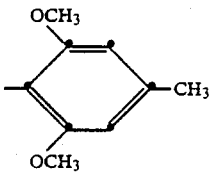

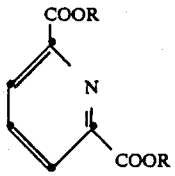

wherein R is

26.

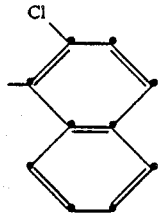

-continued

27.

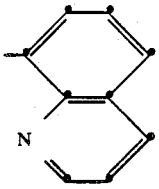

28.

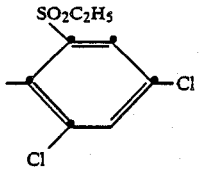

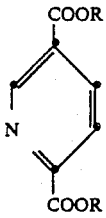

wherein R is

29.

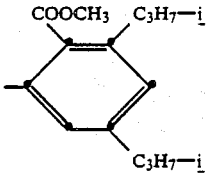

30.

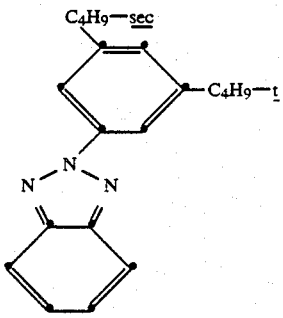

31.

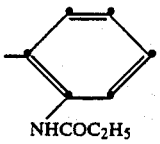

The above compounds may be synthesized by reaction of a di-, tri- or tetra-carboxybenzene acid chloride with the desired ortho-substituted phenol or lithium phenolate.

The dispersion addenda of this invention can be used in the ways and for the purposes that such compounds are used in the photographic art. Each may be used alone or in combination in any concentration which is effective for the intended purpose. Generally, good results have been obtained using concentrations ranging from about 0.1 to about 1.0 g/m$^2$, preferably from 0.2 to 0.5 g/m$^2$.

Typically, coupler dispersions comprising couplers, coupler solvents, and dispersion addenda are incorporated in the silver halide emulsion layers coated on a support to form a photographic element. Alternatively, the coupler dispersion can be incorporated in photographic layers adjacent to the silver halide emulsion where, during development, the coupler will be in reactive association with development products such as oxidized color developing agent.

Photographic elements of the invention can be single color elements or multicolor elements. Multicolor elements contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore, U.S. Pat. No. 4,362,806 issued Dec. 7, 1982.

A typical multicolor photographic element of the invention comprises a support having thereon a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler, at least one of the couplers in the element being dissolved in a coupler solvent together with a dispersion addendum of this invention. The element can contain additional layers, such as filter layers, interlayers, overcoat layers, subbing layers, and the like.

In the following discussion of suitable materials for use in the emulsions and elements of this invention, reference will be made to *Research Disclosure*, December 1978, Item 17643, published by Industrial Opportunities Ltd., Homewell Havant, Hampshire, PO9 1EF, U.K., the disclosures of which are incorporated herein by reference. This publication will be identified hereafter by the term "Research Disclosure".

The silver halide emulsions employed in the elements of this invention can be either negative-working or positive-working. Suitable emulsions and their preparation are described in Research Disclosure Sections I and II and the publications cited therein. Suitable vehicles for the emulsion layers and other layers of elements of this invention are described in Research Disclosure Section IX and the publications cited therein.

In addition to the couplers generally described above, the elements of the invention can include additional couplers as described in Research Disclosure Section VII, paragraphs D, E, F and G and the publications cited therein. These couplers can be incorporated in the elements and emulsions as described in Research Disclosure Section VII, paragraph C and the publications cited therein.

The photographic elements of this invention or individual layers thereof, can contain brighteners (see Research Disclosure Section V), antifoggants and stabilizers (see Research Disclosure Section VI), antistain agents and image dye stabilizers (see Research Disclosure Section VII, paragraphs I and J), light absorbing and scattering materials (see Research Disclosure Section VIII), hardeners (see Research Disclosure Section XI), plasticizers and lubricants (see Research Disclosure Section XII), antistatic agents (see Research Disclosure Section XIII), matting agents (see Research Disclosure Section XVI) and development modifiers (see Research Disclosure Section XXI).

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents useful in the invention are p-phenylene diamines. Especially preferred are 4-amino-N,N-diethyl-aniline hydrochloride, 4-amino-3-methyl-N,N-diethylaniline hydrochloride, 4-amino-3-methyl-N-ethyl-N-$\beta$-(methanesulfonamido)ethylaniline sulfate hydrate, 4-amino-3-methyl-N-ethyl-$\beta$-hydroxyethylaniline sulfate, 4-amino-3-$\beta$-(methanesulfonamido)ethyl-N,N-diethyl-aniline hydrochloride and 4-amino-3-methyl-N-ethyl-N-(2-methoxyethyl)aniline di-p-toluenesulfonic acid.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

The following examples are included for a further understanding of this invention.

EXAMPLE 1

Preparation of Bis(2,6-Dimethylphenyl)Phthalate (Compound 1)

To a stirred solution of 15.9 g (0.13 mol) 2,6-dimethylphenol and 19.8 g (0.20 mol) triethylamine in 100 mL dry tetrahydrofuran was added portionwise under argon 17.3 g (0.085 mol) phthaloyl chloride. After stirring overnight the mixture was poured into dilute hydrochloric acid and the product isolated by extraction. Purification by recrystallization from acetonitrile and then ethyl acetate gave 14.6 g Compound 1 as colorless crystals, m.p. 174°-6° C., confirmed by an nmr spectrum and elemental analysis.

EXAMPLE 2

Preparation of Bis(2,4-Di-tert-phenyl)Isophthalate (Compound 13)

To a stirred solution of 23.5 g (0.10 mol) 2,4-di-tert-pentylphenol and 11.1 g (0.11 mol) triethylamine in 100 mL tetrahydrofuran was rapidly added 10.2 g (0.05 mol) isophthaloyl chloride. After 90 minutes the mixture was poured into dilute hydrochloric acid and isolated by extraction. Purification by crystallization from ligroin gave 25.5 g Compound 13 as a colorless solid, m.p. 65°-75° C., with the expected nmr spectrum and elemental analysis.

EXAMPLE 3

Preparation of Bis(2,6-di-tert-butyl-4-methylphenyl)Phthalate (Compound 6)

To a stirred, ice-cold solution of 11.6 g (0.05 mol) 2,6-di-tert-butyl-4-methylphenol in 100 mL dry tetrahydrofuran was added dropwise under argon 25 mL 23M n-butyllithium in hexane. After 2.5 hours, 5.3 g (0.026 mol) fresh phthaloyl chloride was added dropwise and the mixture stirred overnight at room temperature. Product was isolated by extraction, washed with ligroin and recrystallized from acetonitrile to give 4 g nearly pure Compound 6, as white crystals, m.p. 262°-5° C.

EXAMPLE 4

Cyan Dye Stability

Photographic elements were prepared by coating a gel-subbed, polyethylene-coated paper support with a photosensitive layer containing a silver bromoiodide emulsion at 0.28 g Ag/m$^2$, gelatin at 1.62 g/m$^2$, and cyan coupler A at 624 mg/m$^2$ (1.26 mmoles/m$^2$) dispersed in half its weight of dibutyl phthalate and the weight of dispersion addendum indicated in Table 1. Dispersions were thus prepared containing either the addenda compounds of the invention or various comparison addenda (CA) as controls.

The photosensitive layer was overcoated with a layer containing gelatin at 1.08 g/m$^2$ and bis-vinylsulfonylmethyl ether hardener at 2 weight percent based on total gelatin.

Cyan Couplers Employed

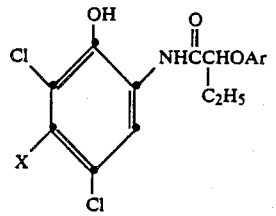

| Coupler | X | Ar |
|---|---|---|
| A | $-CH_3$ | 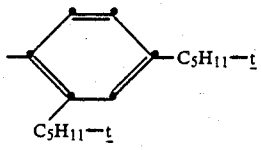  |
| B | $-C_2H_5$ | 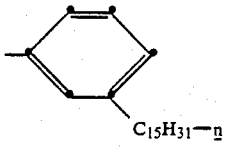  |

Comparison Addenda Compounds CA-1-CA-3

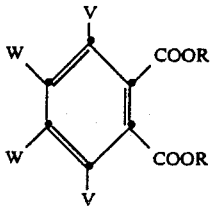

| Comparison Addenda Compounds | W | V | R |
|---|---|---|---|
| CA-1 | H | H | 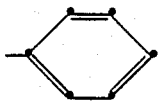 (U.S. Pat. No. 4,451,558, Cmpd. P-19) |

-continued

CA-2

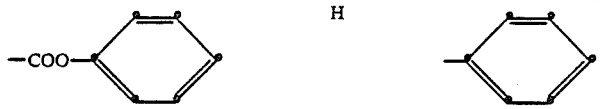

CA-3

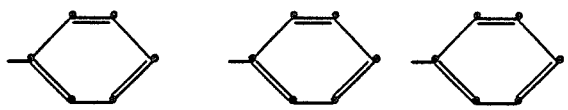

Comparison Addenda Compound CA-4

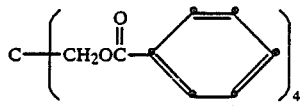

(U.S. Pat. No. 3,779,765, Cmpd. 2)

Comparison Addenda Compound CA-5

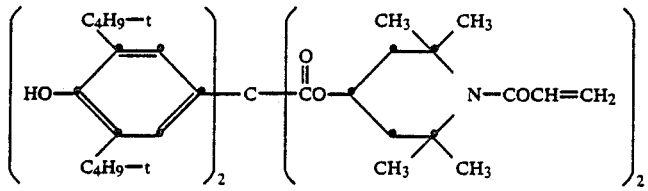

Samples of each element were imagewise exposed through a graduated-density test object, processed at 33° C. employing the color developer identified below, then 1.5 minutes in the bleach-fix bath, washed and dried.

| | |
|---|---|
| Color Developer (pH 10.08) | |
| Triethanolamine | 11 mL |
| Benzyl alcohol | 14.2 mL |
| Lithium chloride | 2.1 g |
| Potassium bromide | 0.6 g |
| Hydroxylamine sulfate | 3.2 g |
| Potassium sulfite (45% solution) | 2.8 mL |
| 1-Hydroxyethylene-1,1-diphosphoric acid (60%) | 0.8 mL |
| 4-Amino-3-methyl-N—ethyl-N—β-methanesulfonamido)ethylaniline sulfate hydrate | 4.35 g |
| Potassium carbonate (anhydrous) | 28 g |
| Stilbene whitening agent | 0.6 g |
| Surfactant | 1 mL |
| Water to make | 1.0 liter |
| Bleach-Fix Bath (pH 6.8) | |
| Ammonium thiosulfate | 104 g |
| Sodium hydrogen sulfite | 13 g |
| Ferric ammonium ethylenediamine tetraacetic acid (EDTA) | 65.6 g |
| EDTA | 6.56 g |
| Ammonium hydroxide (28%) | 27.9 mL |
| Water to make | 1 liter |

The spectral absorption curves were determined for processed strips with the peak absorption (λmax) normalized to D=1.0 and the half bandwidth measured as the absorption breadth at D=0.5. Dye images of replicate processed strips were then subjected to the following stability tests as indicated (A Wratten 2B filter removed the ultraviolet component in light fade tests):

HID—high intensity daylight, 50 Klux xenon
SANS—simulated average north skylight, 5.4 Klux xenon
W.O.—60° C./70% R.H. "wet oven," dark keeping
D.O.—77° C./5% R.H. "dry oven," dark keeping.

The following results were obtained:

TABLE 1

| Additional Dispersion Addendum Compound | mg/m² | λmax (nm) | HBW (nm) | Density loss from D = 1.7 24 wk. SANS | 6 wk. W.O. | 2 wk. D.O. |
|---|---|---|---|---|---|---|
| (A)* | | | | | | |
| none | — | 661 | 175 | −.10 | −.67 | −.66 |
| CA-5 | 474 | 659 | 167 | −.07 | −.51 | −.55 |
| 1 | 194 | 660 | 179 | −.10 | −.59 | −.63 |
| 3 | 248 | 662 | 171 | −.14 | −.53 | −.55 |
| 4 | 269 | 658 | 173 | −.07 | −.40 | −.48 |
| 12 | 269 | 664 | 170 | −.08 | −.36 | −.45 |
| 5 | 301 | 661 | 171 | −.07 | −.44 | −.45 |
| 13 | 301 | 659 | 168 | −.06 | −.40 | −.50 |
| 8 | 420 | 660 | 161 | −.06 | −.44 | −.57 |
| (B) | | | | | | |
| none | — | 659 | 177 | −.09 | −.51 | −.60 |
| CA-5 | 474 | 657 | 164 | −.06 | −.35 | −.55 |
| 19 | 474 | 656 | 164 | −.05 | −.29 | −.44 |
| (C) | | | | | | |
| none | — | 658 | 175 | −.10 | −.57 | −.70 |
| CA-5 | 474 | 654 | 166 | −.08 | −.46 | −.62 |
| 5 | 474 | 658 | 170 | −.09 | −.31 | −.47 |
| 13 | 474 | 659 | 166 | −.08 | −.27 | −.48 |
| (D)* | | | | | | |
| none | — | 660 | 174 | −.07 | −.53 | −.61 |
| CA-5 | 474 | 658 | 166 | −.02 | −.37 | −.49 |
| 20 | 452 | 658 | 171 | −.05 | −.38 | −.41 |

*In sections A and D, compounds were added at 0.5 mole/mole coupler.

It can be seen from the data of Table 1 that use of the compounds of this invention had little effect on dye hue (λmax) but often provided small improvements in hue purity evidenced by a narrower half bandwidth. Dramatic improvements in fade resistance to heat (D.O.) and humidity (W.O.) were also achieved with the compounds of the invention as well as smaller improvements in light fade resistance (SANS). In many instances, improvements were also obtained in comparison to CA-5, a commercially available compound (although not structurally similar to compounds of the invention).

EXAMPLE 5

Ferrous Ion Stability and Cyan Dye Stability Tests

Photographic elements were prepared and tested as in Example 4, except that an equimolar amount of cyan coupler B (see Example 4) replaced cyan coupler A. The data reported in Section C of Table 2 result from dispersions containing cyan coupler B dispersed in half its weight of bis(2-ethylhexyl)phthalate and the indicated weight of dispersion addendum compound. Processed strips were also subjected to a ferrous ion ($Fe^{II}$) stability test and percent density loss was measured after 5 minute immersion in the following solution:

| 0.1 M Ferrous Ion Solution (made under nitrogen purging) | |
|---|---|
| Degassed distilled water | 750 mL |
| EDTA | 32.12 g |
| Ammonium hydroxide (conc. solution) | 15 mL |
| Ferrous sulfate.$7H_2O$ | 27.8 g |
| Ammonium hydroxide and water to: | 1.0 L |
| (Nitric acid to adjust pH down to 5.0) | |

The following results were obtained:

TABLE 2

| Additional Dispersion Addendum Compound | mg/m² | λmax (nm) | HBW (nm) | Density loss from D = 1.7 2 wk. HID | 6 wk. W.O. | 2 wk. D.O. | $Fe^{II}$ |
|---|---|---|---|---|---|---|---|
| (A) | | | | | | | |
| none | — | 663 | 170 | −.12 | −.01 | −.12 | — |
| CA-5 | 474 | 660 | 170 | −.13 | .00 | −.08 | — |
| 4 | 474 | 661 | 164 | −.11 | .00 | −.08 | — |
| 5 | 474 | 661 | 166 | −.13 | +.03 | −.04 | — |
| 13 | 474 | 660 | 164 | −.13 | +.03 | −.09 | — |
| (B) | | | | | | | |
| none | — | 665 | 169 | −.16 | +.01 | −.12 | −47% |
| CA-5 | 474 | 661 | 162 | −.17 | +.04 | −.07 | −19% |
| 12 | 474 | 659 | 164 | −.14 | +.05 | −.06 | −19% |
| 19 | 474 | 664 | 156 | −.17 | −.07 | −.10 | −14% |
| (C) | | | | | | | |
| none | — | 660 | 170 | −.16 | .00 | −.13 | −25% |
| CA-5 | 474 | 660 | 160 | −.10 | +.05 | −.08 | −17% |
| 12 | 474 | 661 | 160 | −.17 | −.02 | −.03 | −13% |
| 19 | 474 | 663 | 160 | −.16 | −.05 | −.07 | −18% |
| 5 | 474 | 663 | 164 | −.16 | +.02 | −.08 | −13% |
| 13 | 474 | 658 | 159 | −.18 | −.16 | −.08 | −14% |

The results show that employing the compounds of the invention can greatly reduce this cyan dye's sensitivity to ferrous ion, and significant improvements in high temperature dark keeping can be obtained along with small improvements in dye hue purity (narrower half bandwidths) without substantially shifting the peak absorption. In some instances, improvements were also obtained in comparison to CA-5, a commercially available compound (although not structurally similar to compounds of the invention).

EXAMPLE 6

Yellow Dye Light Stability Test

Photographic elements were prepared and processed as in Example 4 except that the coatings contained 0.40 g Ag/m², 1.09 millimole/m² (990 mg/m²) of a yellow dye-forming coupler, and one-fourth the coupler weight of dibutyl phthalate and the coupler dispersion addenda listed in Table 3 in the amounts listed.

yellow dye-forming coupler

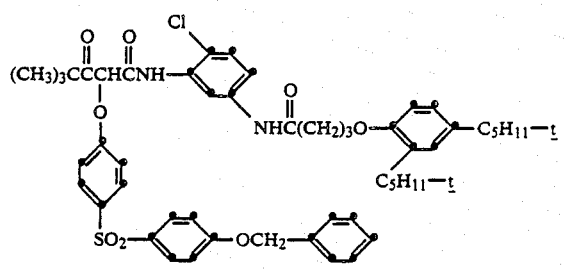

The following results were obtained:

TABLE 3

| Add'l. Dispersion Addendum Compound | mg/m² | λmax (nm) | HBW (nm) | Density loss from D = 1.7 4 wk. HID | 24 wk. SANS | 6 wk. W.O. | 2 wk. D.O. |
|---|---|---|---|---|---|---|---|
| (A)* | | | | | | | |
| none | — | 446 | 102 | −.51 | −.28 | −.08 | −.03 |
| CA-1 | 172 | 446 | 104 | −.72 | −.42 | −.06 | +.01 |
| 1 | 194 | 445 | 102 | −.48 | −.20 | −.05 | .00 |
| 3 | 269 | 443 | 101 | −.23 | −.13 | −.07 | −.01 |
| 5 | 323 | 446 | 101 | −.19 | −.13 | −.01 | −.01 |
| 13 | 323 | 445 | 100 | −.20 | −.10 | −.02 | −.01 |

TABLE 3-continued

| Add'l. Dispersion Addendum Compound | mg/m² | λmax (nm) | HBW (nm) | Density loss from D = 1.7 4 wk. HID | 24 wk. SANS | 6 wk. W.O. | 2 wk. D.O. |
|---|---|---|---|---|---|---|---|
| 6 | 312 | 448 | 103 | −.56 | −.24 | −.01 | +.02 |
| 7 | 366 | 447 | 102 | −.48 | −.25 | −.06 | +.03 |
| 8 | 452 | 449 | 97 | −.32 | −.17 | −.03 | +.07 |
| CA-2 | 301 | 446 | 102 | −.85 | −.41 | +.03 | +.14 |
| 20 | 484 | 446 | 101 | −.86 | −.31 | −.03 | +.04 |
| (B)* | | | | | | | |
| none | — | 447 | 102 | −.57 | −.36 | −.04 | −.01 |
| CA-5 | 506 | 446 | 100 | −.13 | −.08 | +.11 | +.05 |
| 4 | 291 | 448 | 102 | −.21 | −.12 | +.01 | .00 |
| 12 | 291 | 448 | 101 | −.19 | −.10 | −.02 | +.02 |
| (C) | | | | | | | |
| none | — | 447 | 104 | −.38 | −.33 | −.09 | +.03 |
| CA-5 | 506 | 445 | 101 | −.15 | −.10 | +.10 | +.03 |
| 19 | 506 | 444 | 100 | −.14 | −.13 | −.06 | +.04 |
| (D) | | | | | | | |
| none | — | 446 | 102 | −.41 | −.35 | −.09 | −.01 |
| CA-4 | 506 | 445 | 101 | −.21 | −.18 | −.03 | −.05 |
| CA-5 | 506 | 445 | 100 | −.12 | −.12 | +.03 | .00 |
| 3 | 506 | 447 | 99 | −.19 | −.13 | −.04 | −.02 |
| 4 | 506 | 446 | 100 | −.18 | −.12 | −.02 | .00 |
| 12 | 506 | 445 | 100 | −.16 | −.11 | −.02 | .00 |
| 5 | 506 | 445 | 100 | −.16 | −.14 | −.02 | −.01 |
| 13 | 506 | 444 | 100 | −.19 | −.13 | .00 | −.06 |

*In sections A and B, compounds were added at 0.5 mole/mole coupler.

The above data show that compounds of this invention provide substantial improvements in yellow dye stability to light fade as well as smaller improvements in dark keeping stability under adverse conditions of heat and humidity. Comparison addenda CA-1 and CA-2 of closely related structure to the compounds of the invention but lacking the bulky substituents, often led to worse fading, especially in the light.

Dye hue was essentially unaffected by the compounds of the invention, but they gave improvements in upper-scale contrast and 0.1 to 0.2 higher D-max in sensitometric curves.

The invention has been described in detail with particular reference to preferred embodiments thereof, but it will be understood that variations and modifications can be effected within the spirit and scope of the invention.

What is claimed is:

1. A photographic element comprising a support having thereon at least one silver halide emulsion layer having associated therewith a dye-forming coupler dispersed in a coupler solvent therefor together with a dispersion addendum having the formula:

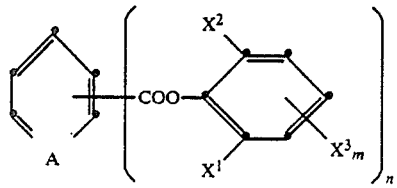

wherein

A is CH or N;

each $X^1$, $X^2$ and $X^3$ can independently be —H, halogen, —R, —CH=NOR, —COR, —$SO_2$R, —YR, —Y-COR, —COYR, —Y$SO_2$R or —$SO_2$YR, wherein Y is O, S or NR' and R' is H or R;

or two X groups can join together to form a heterocyclic ring;

R can be a substituted or unsubstituted alkyl group, a substituted or unsubstituted aryl group or a substituted or unsubstituted heterocyclic group;

n is 2, 3 or 4 and each m is 1, 2 or 3;

with the proviso that at least one pair of $X^1$ and $X^2$ substituents attached to the same benzene ring must contain a total of two or more non-hydrogen atoms, and with the further proviso that only one of $X^1$, $X^2$ and $X^3$ substituents attached to the same benzene ring may be hydrogen.

2. The element of claim 1 wherein said dye-forming coupler forms a cyan dye upon reaction with oxidized color developing agent.

3. The element of claim 2 wherein said cyan dye-forming coupler is a phenol or a naphthol and said coupler and said dispersion addendum are located in said silver halide emulsion layer.

4. The element of claim 1 wherein n is 2, m is 1 and A is CH.

5. The element of claim 4 wherein each $X^1$, $X^2$ and $X^3$ independently is an alkyl group of from 1 to about 6 carbon atoms.

6. The element of claim 4 wherein $X^1$ is a heterocyclic group, $X^2$ is H or an alkyl group of from 1 to about 6 carbon atoms and $X^3$ is an alkyl group of from 1 to about 6 carbon atoms.

7. The element of claim 4 wherein $X^1$ is —$COR^1$ wherein $R^1$ is phenyl, $X^2$ is hydrogen and $X^3$ is methoxy.

8. The element of claim 4 wherein $X^2$ is hydrogen and each $X^1$ and $X^3$ independently is an alkyl group of from 2 to about 6 carbon atoms.

9. The element of claim 1 wherein n is 4, m is 1, each $X^1$ and $X^2$ independently is an alkyl group of from 1 to about 6 carbon atoms and $X^3$ is hydrogen.

* * * * *